US008725500B2

(12) United States Patent
Gibbs et al.

(10) Patent No.: US 8,725,500 B2
(45) Date of Patent: May 13, 2014

(54) APPARATUS AND METHOD FOR ENCODING AT LEAST ONE PARAMETER ASSOCIATED WITH A SIGNAL SOURCE

(75) Inventors: Jonathan A Gibbs, Winchester (GB); James P Ashley, Naperville, IL (US); Holly L Francois, Guildford (GB); Udar Mittal, Hoffman Estates, IL (US)

(73) Assignee: Motorola Mobility LLC, Chicago, IL (US)

( * ) Notice: Subject to any disclaimer, the term of this patent is extended or adjusted under 35 U.S.C. 154(b) by 952 days.

(21) Appl. No.: 12/273,974

(22) Filed: Nov. 19, 2008

(65) Prior Publication Data

US 2010/0125453 A1 May 20, 2010

(51) Int. Cl.
*G10L 19/00* (2013.01)

(52) U.S. Cl.
USPC ..... 704/219; 704/221; 704/222; 704/229; 704/230

(58) Field of Classification Search
CPC ..... G10L 19/00; G10L 19/03; G10L 19/032; G10L 19/035; G10L 19/038
USPC ..... 704/219, 221, 227, 229, 230, 222
See application file for complete search history.

(56) References Cited

U.S. PATENT DOCUMENTS 4,899,383 A * 2/1990 Einolf et al. ..... 370/510
5,239,543 A * 8/1993 Janssens ..... 370/458
5,884,269 A * 3/1999 Cellier et al. ..... 704/501
6,496,798 B1 12/2002 Huang et al.
7,016,340 B1 * 3/2006 McKinion ..... 370/352
7,230,550 B1 6/2007 Mittal et al.
2004/0039464 A1 * 2/2004 Virolainen et al. ..... 700/94
2007/0156725 A1 7/2007 Ehret et al.

FOREIGN PATENT DOCUMENTS

WO 2008010836 A1 1/2008

OTHER PUBLICATIONS

International Telecommunication Union, G.729.1, Series G: Transmission Systems and Media, Digital Systems and Networks, Digital Terminal Equipments—Coding of analogue signals by methods other than PCM, G.729 based Embedded Variable bit-rate coder, May 2006.

Bensa, Julien: "The International Search Report and the Written Opinion of the International Searching Authority", European Patent Office, Rijswijk, completed: Feb. 12, 2010, mailed: Feb. 18, 2010, all pages.

Japanese Patent Office, Non-Final Office Action for Japanese patent Application No. 2011-537486 dated Oct. 30, 2012, 3 pages.

* cited by examiner

*Primary Examiner* — Qi Han

(57) ABSTRACT

Apparatus (119) for encoding at least one parameter associated with a signal source for transmission over k frames to a decoder comprises a processor (119) which is configured in operation to assign a predetermined bit pattern to n bits associated with the at least one parameter of a first frame of k frames and set the n bits associated with the at least one parameter of each of k−1 subsequent frames to values, such that the values of the n bits of the k−1 subsequent frames represent the at least one parameter. The predetermined bit pattern indicates a start of the at least one parameter.

7 Claims, 5 Drawing Sheets

| | | | | k VALUES | | | | | |
|---|---|---|---|---|---|---|---|---|---|
| n VALUES | 2 | 3 | 4 | 5 | 6 | 7 | 8 | 9 | 10 |
| 2 | 3 | 9 | 27 | 81 | 243 | 729 | 2187 | 6561 | 19683 |
| 3 | 7 | 49 | 343 | 2401 | 16807 | 117649 | 823543 | 5764801 | 40353607 |
| 4 | 15 | 225 | 3375 | 50625 | 759375 | 11390625 | 1.71E+08 | 2.56E+09 | 3.84E+10 |
| 5 | 31 | 961 | 29791 | 923521 | 28629151 | 8.88E+08 | 2.75E+10 | 8.53E+11 | 2.64E+13 |
| 6 | 63 | 3969 | 250047 | 15752961 | 9.92E+08 | 6.25E+10 | 3.94E+12 | 2.48E+14 | 1.56E+16 |
| 7 | 127 | 16129 | 2048383 | 2.6E+08 | 3.3E+10 | 4.2E+12 | 5.33E+14 | 6.77E+16 | 8.59E+18 |
| 8 | 255 | 65025 | 16581375 | 4.23E+09 | 1.08E+12 | 2.75E+14 | 7.01E+16 | 1.79E+19 | 4.56E+21 |
| 9 | 511 | 261121 | 1.33E+08 | 6.82E+10 | 3.48E+13 | 1.78E+16 | 9.1E+18 | 4.65E+21 | 2.38E+24 |
| 10 | 1023 | 1046529 | 1.07E+09 | 1.1E+12 | 1.12E+15 | 1.15E+18 | 1.17E+21 | 1.2E+24 | 1.23E+27 |

*FIG. 3*

| | | | | k VALUES | | | | | |
|---|---|---|---|---|---|---|---|---|---|
| n VALUES | 2 | 3 | 4 | 5 | 6 | 7 | 8 | 9 | 10 |
| 2 | 39.62406 | 52.83208 | 59.43609 | 63.3985 | 66.0401 | 67.92696 | 69.34211 | 70.44278 | 71.32331 |
| 3 | 46.78925 | 62.38566 | 70.18387 | 74.8628 | 77.98208 | 80.21014 | 81.88119 | 83.18089 | 84.22065 |
| 4 | 48.83613 | 65.11484 | 73.2542 | 78.13781 | 81.39355 | 83.71908 | 85.46323 | 86.81979 | 87.90504 |
| 5 | 49.54196 | 66.05595 | 74.31294 | 79.26714 | 82.56994 | 84.92908 | 86.69844 | 88.0746 | 89.17553 |
| 6 | 49.81067 | 66.41422 | 74.716 | 79.69707 | 83.01778 | 85.38971 | 87.16867 | 88.5523 | 89.6592 |
| 7 | 49.91918 | 66.5589 | 74.87876 | 79.87068 | 83.19863 | 85.57573 | 87.35856 | 88.7452 | 89.85452 |
| 8 | 49.96471 | 66.61961 | 74.94706 | 79.94353 | 83.27451 | 85.65379 | 87.43824 | 88.82615 | 89.93648 |
| 9 | 49.98433 | 66.64577 | 74.9765 | 79.97493 | 83.30722 | 85.68742 | 87.47258 | 88.86103 | 89.97179 |
| 10 | 49.99295 | 66.65727 | 74.98943 | 79.98872 | 83.32159 | 85.7022 | 87.48767 | 88.87636 | 89.98731 |

*FIG. 4*

APPARATUS AND METHOD FOR ENCODING AT LEAST ONE PARAMETER ASSOCIATED WITH A SIGNAL SOURCE

FIELD OF THE DISCLOSURE

This disclosure relates to an apparatus and method for encoding at least one parameter associated with a signal source for transmission over a plurality of frames.

BACKGROUND

Frame based encoders, such as speech encoders, use audio signal processing techniques to model a speech signal, and generic data compression algorithms to represent the resulting modelled speech signal in a compact bitstream, which is then transmitted over sequential frames to a decoder. Each of the sequential frames thus includes the coded speech signal and also parameters associated with the speech signal, which parameters are decoded by the decoder and used to enhance the rendering of the decoded speech signal.

In the case of stereo recording, such as in audio and video conferencing as well as broadcasting applications, a stereo signal may be recorded using two microphones. When the two microphones are spaced apart, the recorded signal from a speaker located closer to one microphone than the other, reaches the latter microphone with a delay relative to the other microphone. In order to take account of the delay of the speech signal between the different microphones, a parameter known as the stereo delay parameter or inter-channel time difference (ITD) parameter may be determined from the recorded stereo signal and encoded and transmitted over the frames together with the encoded speech signal and other parameters that describe aspects of the stereo speech signal. These transmitted parameters are used in the decoder to recreate the stereo signal. The ITD parameter may significantly improve the quality of the recreated stereo perspective since ITD is known to be the dominant perceptual influence on stereo location for frequencies below approximately 1 kHz.

Typically, speech encoders employ frame rates of 20 ms which means that each bit within a speech frame consumes 50 bits/s and the synchronous frame structure lends itself to the update of parameters at multiples of 50 Hz. Such update rates are commensurate with the rates of change experienced within the human vocal tract. For example, it is well known that the human vocal tract shape may be adequately represented by parameters (such as the Linear Predictive Code (LPC) parameter) at an update rate of approximately 50 Hz, whereas the speech excitation energy and shape is best modelled at approximately 200 Hz (i.e., the excitation parameters are updated at 200 Hz).

However, as speech encoder functionality is augmented to provide music and stereo coding, such as in the speech encoder known as the Embedded Variable Bit-Rate (EV-VBR) codec which is currently being standardised by the International Telecommunication Union (ITU), additional parameters need to be coded which do not relate to the human vocal tract. Some of these parameters vary at a rate slower than the frame rate and thus, the sending of the same parameter every frame, irrespective of whether the parameter has changed, represents a waste of channel bandwidth resources. Some of these parameters may also require high precision, in terms of numbers of bits, as well as evolve slowly over time. In order to achieve the required high precision, over-sampling combined with a reduction in the number of quantization levels can provide one classical solution but this method has several drawbacks due to the required filtering. Error propagation can occur and there can also be problems with jitter in the output value due to practical realisation of the filter which can also delay the effect of instantaneous parameter changes and introduce difficulties in maintaining encoder and decoder synchronization in analysis-by-synthesis encoder structures.

Thus, it would be advantageous to provide an improved method for encoding and transmitting parameters in a frame based encoding scheme.

BRIEF DESCRIPTION OF THE DRAWINGS

An apparatus and method for encoding at least one parameter associated with a signal source for transmission over a plurality of frames, in accordance with the disclosure will now be described, by way of example only, with reference to the accompanying drawings in which:

FIG. 3 is a table showing the number of possible values that a parameter may have in accordance with an embodiment of the disclosure for various values of n and k;

FIG. 4 is a table showing the bit rate efficiencies as a percentage for various values of n and k.

DETAILED DESCRIPTION

In the following description, embodiments of the disclosure will be described with respect to a speech encoder used as part of a communication device in a teleconference application wherein an ITD parameter is encoded and transmitted over a wireline communication link in order to enhance the stereo signal recreated by a decoder in another communication device. It will however be appreciated the present disclosure can be used in other types of encoders/decoders, such as video, or other audio encoders/decoders, and may also be used in wireless communication devices, such as a subscriber unit, a wireless user equipment, a portable or mobile telephone, a wireless video or multimedia device, a communication terminal, a personal digital assistant (PDA), a laptop computer, or an embedded communication processor. For example, a stereo signal may be recorded when a user is talking in the presence of a Bluetooth™ microphone and a mobile telephone microphone or multiple microphones in a wireless communication system in a car. In such applications, encoding and transmitting the ITD parameter may enhance the experience of the user.

Figure 1:
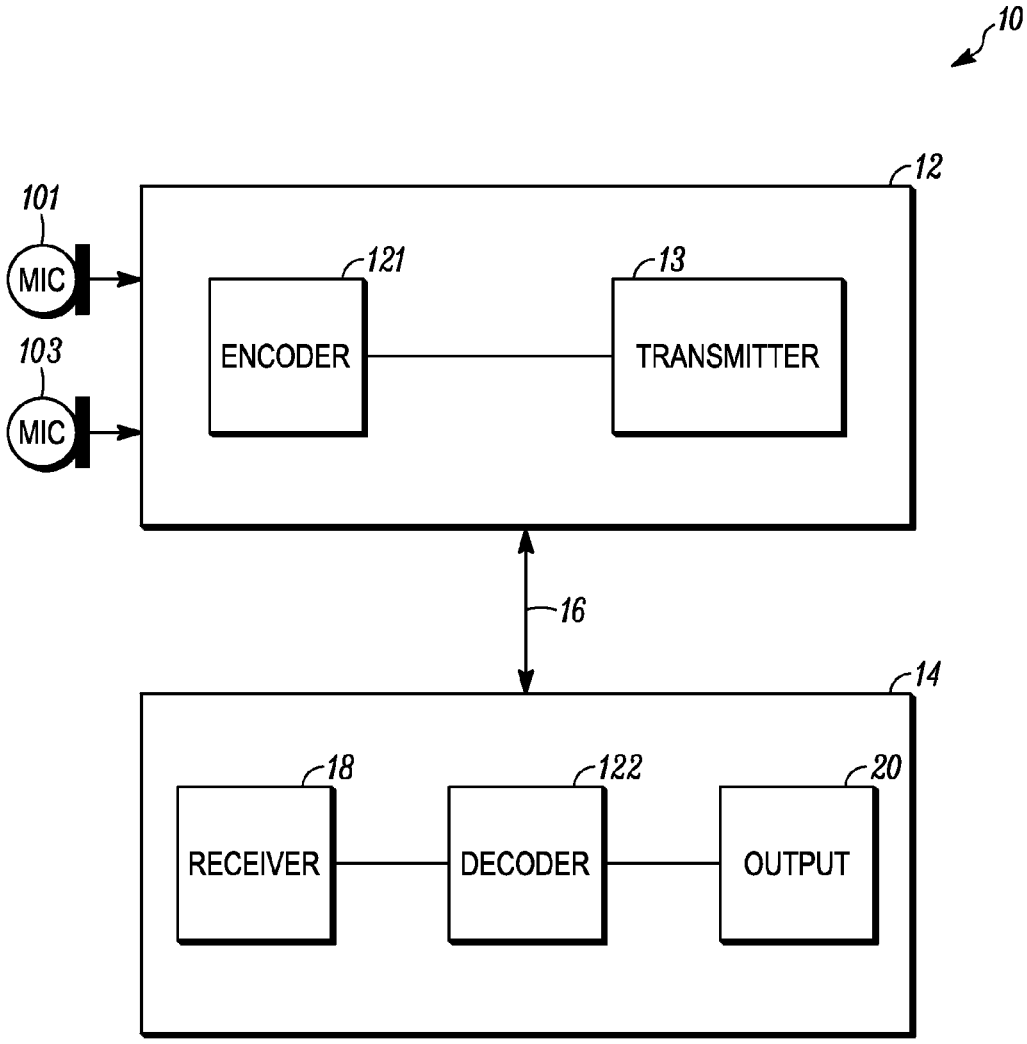
FIG. 1 is a block schematic diagram of a communication system in accordance with an embodiment of the disclosure.

Referring to FIG. 1, a communication system 10, such as a teleconferencing system 10, comprises a communication device 12, acting as a transmitting device, and having an input coupled to microphones 101, 103 for receiving speech signals from users (not shown) of the teleconferencing system 10, an encoding apparatus 121 for encoding the speech signals and parameters associated with the speech signals into a bit stream for transmission over a plurality of frames and a transmitter 13 for transmitting the frames to a communication device 14, acting as a receiving device, via a communication link 16. The receiving communication device 14 comprises a receiver 18 for receiving the encoded signals from the transmitting communication device 12, a decoding apparatus 122 coupled to the receiver 18 for decoding the received encoded signals to provide decoded speech signals and parameters associated with the speech signals and for processing the decoded speech signals according to the parameters so as to provide to a user (or users) of the receiving communication device 14 at an output 20 (such as a pair of loud speakers which may be part of the communication device 14 as shown in FIG. 1 or separate to the device) a re-creation of the original speech signals provided to the microphones 101, 103. As will be apparent to a skilled person, only those functional components of the communication devices 12, 14 that are necessary for an understanding of the disclosure have been shown and will be described.

In an example application, the two microphones 101, 103 are used to record speech signals in a room and are located with an internal distance of up to 3 meters. In a teleconferencing application, when there are a number of people in the room, the use of two or more microphones may provide better audio coverage of the room. The use of more than one microphone results in speech signals being provided to the encoding apparatus 121 on multiple channels. In many multiple channel encoding systems, and in particular in many multiple channel speech encoding systems, the low level encoding is based on encoding of a single channel. In such systems, the multi-channel signal may be converted to a mono signal for the lower layers of a coder to encode. The generation of this mono signal is referred to as down-mixing. Such down-mixing may be associated with parameters that describe aspects of the stereo signal relative to the mono signal. Specifically, the down mixing may generate inter-channel time difference (ITD) information which characterises the timing difference between the left and right channels.

Figure 2:
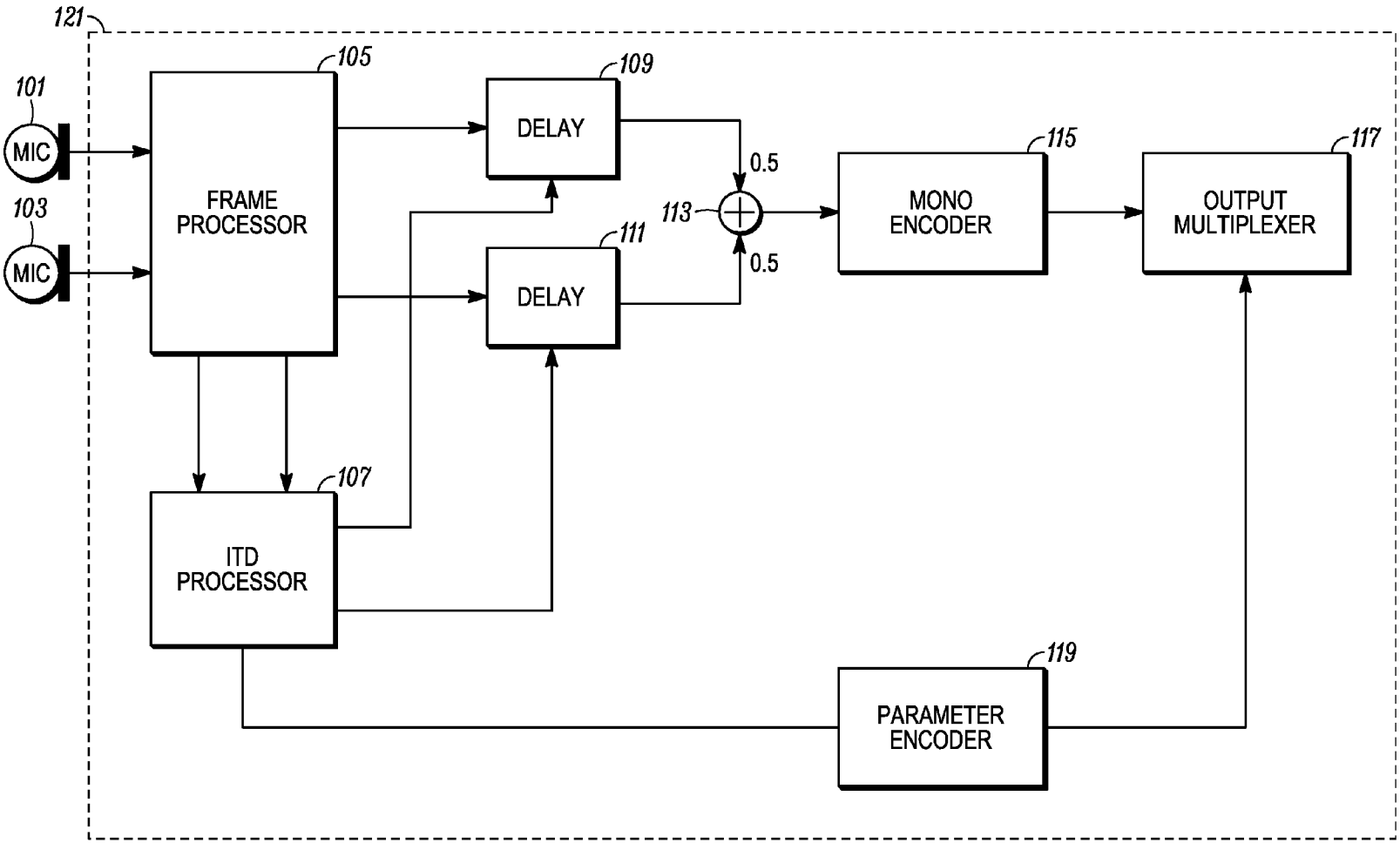
FIG. 2 is a block schematic diagram of an encoding apparatus for encoding speech signals and parameters associated with the speech signals in accordance with an embodiment of the disclosure.

Referring now also to FIG. 2, the microphones 101, 103 are coupled to a frame processor 105 which receives speech signals from the microphones 101, 103 on first and second channels. The frame processor 105 divides the received signals into sequential frames. In an example, the sample frequency is 16 ksamples/sec and the duration of a frame is 20 msec resulting in each frame comprising 320 samples. The frame processing does not result in an additional delay to the speech path.

The frame processor 105 is coupled to an ITD processor 107 which is arranged to determine an ITD parameter or stereo delay parameter between the speech signals from the different microphones 101, 103. The ITD parameter is an indication of the delay of the speech signal in one channel relative to the speech signal in the other. For example, when a speaker who is closer to microphone 101 compared to microphone 103 speaks, the speech signal received at microphone 103 will be delayed compared to the speech signal received at microphone 101 due to the location of the speaker. In order for the delay to be accounted for when the speech signal is recreated at the receiving device 14, the delay parameter is encoded and transmitted to the receiving device 14. In the example, the ITD parameter may be positive or negative depending on which of the channels is delayed relative to the other. The delay will typically occur due to the difference in the delays between the dominant speech source (i.e., the speaker currently speaking) and the microphones 101, 103.

In the embodiment shown in FIG. 2, the ITD processor 107 is furthermore coupled to two delays 109, 111. The first delay 109 is arranged to introduce a delay to the first channel and the second delay 111 is arranged to introduce a delay to the second channel. The amount of the delay that is introduced depends on the ITD parameter determined by the ITD processor 107. Furthermore, in a specific example only one of the delays is used at any given time. Thus, depending on the sign of the estimated ITD parameter, the delay is either introduced to the first or the second signal. The amount of delay is specifically set to be as close to the ITD parameter as possible. As a consequence, the speech signals at the output of the delays 109, 111 are closely time aligned and will specifically have an inter time difference which typically will be close to zero.

The delays 109, 111 are coupled to a combiner 113 which generates a mono signal by combining the two output signals from the delays 109, 111. In the example, the combiner 113 is a simple summation unit which adds the two signals together. Furthermore, the signals are scaled by a factor of 0.5 in order to maintain the amplitude of the mono signal similar to the amplitude of the individual signals prior to the combination. In alternative arrangements, the delays 109, 111, can be omitted.

Thus, the output of the combiner 113 is a mono signal which is a down-mix of the two speech signals received at the microphones 101 and 103.

The combiner 113 is coupled to a mono encoder 115 which performs a mono encoding of the mono signal to generate encoded speech data. In the specific example, the mono encoder is a Code Excited Linear Prediction (CELP) encoder in accordance with the EV-VBR Standard.

The mono encoder 115 is coupled to an output multiplexer 117 which is furthermore coupled to the ITD processor 107 via apparatus 119.

Apparatus 119 or parameter encoder 119 is arranged to encode at least one parameter associated with a signal source for transmission over k frames to a decoder, for example the decoding apparatus 122 of receiving device 14. In the example described herein, apparatus 119 is arranged to encode the ITD parameter associated with the speech signals at microphones 101 and 103. Apparatus 119 comprises a processor 119 configured in operation to assign a predetermined bit pattern to n bits associated with the ITD parameter of a first frame of the k frames and set the n bits associated with the ITD parameter of each of k−1 subsequent frames to values, such that the values of the n bits of the k−1 subsequent frames represent the at least one parameter. The predetermined bit pattern indicates a start of the at least one parameter.

In an embodiment, k and n are integers greater than one and are selected so that n bits per frame are dedicated to the transmission of the ITD parameter with an update rate over every k frames which will be sufficient to exceed the Nyquist rate for the parameter once the scheme overheads have been taken into account. The transmission of the ITD parameter over k frames is initiated by sending the predetermined bit pattern with the first frame using the available n bits associated with the ITD parameter. Typically, the predetermined bit pattern is all zeros.

In an embodiment, the values of the n bits in each of the k−1 subsequent frames are selected to be different to the values of the n bits of the predetermined bit pattern. There are therefore $2^n-1$ possible values for the n bits which avoid the predetermined bit pattern. The values of the n bits in each of the k−1 subsequent frames are used to build up the ITD parameter, beginning with the least significant or most significant digit of the ITD parameter in base $2^n-1$. The number of possible values which the ITD parameter can have is $(2^n-1)^{(k-1)}$, given that k n bits have been transmitted. This leads to a transmission efficiency of 100/(k n). (k−1) log 2($2^n$−1) percent. For realistic implementations, efficiency exceeds 66% and can easily exceed 85%.

FIG. 3 provides a table showing the number of possible values for various values of n and k. FIG. 4 provides a table showing the bit rate efficiencies as a percentage for various values of n and k.

Thus, by encoding the parameter into n bits per frame and transmitting the encoded parameter over k−1 frames, the encoding arrangement in accordance with the disclosure can update parameters at a slower rate than the frame rate and can also use fewer bits in a frame to transmit the encoded parameter, i.e., have improved transmission efficiency.

In an embodiment, the parameter is defined to have a value in a predetermined range of values. In other words, the parameter has a predefined length. For example, the ITD parameter can take a value in the range of −48 to +48. From FIG. 3, it can be seen that for n=2 and k=5, 81 possible values may be represented: that is, +/−40. By transforming the ITD parameter from the range −48 to +48 to the range −40 to +40, the value of the ITD parameter may be represented by 2 bits per frame over 5 frames.

In a case where a parameter has a value in a predetermined range with the n bits of k−1 frames providing $(2^n-1)^{(k-1)}$ values which include the predetermined range and which also include values falling outside the predetermined range, the values outside the range can be used at the decoding apparatus 122 to detect errors in the received encoded signal. For example, if a parameter has a value in the range of 1-20 and n is chosen to be 2 and k is chosen to be 4, as can be seen from FIG. 3, the number of possible values over k−1 frames is 27. Thus, the values 21-27 do not fall within the predetermined range of the parameter. When the decoding apparatus 122 decodes the two bits of the received four frames and determines that the decoded parameter has a value in the range of 21-27, then the decoding apparatus 122 will detect an error. Once an error is detected, the decoding apparatus 122 may take appropriate action. For example, the decoding apparatus 122 may ignore the erroneously received value and assume that the previously received value is still valid, or alternatively it may perform an appropriate error mitigation procedure for the parameter in question.

Assigning a predetermined bit pattern to n bits of a first frame of k frames enables the predetermined bit pattern to indicate a start of the transmission of the ITD parameter so that processor 119 can initiate asynchronous transmission of the ITD parameter at any time simply by arranging for the predetermined bit pattern to be sent in the next frame followed by k−1 subsequent frames. Asynchronous transmission of the ITD parameter ensures that there are minimum delays between when the value of the ITD parameter changes and when the new value is transmitted. For example, when the value of the ITD parameter changes, the predetermined bit pattern can be sent in the next frame followed by the new value for the ITD parameter even when the communication device 12 has not completed transmitting a previous value of the ITD parameter. In order to provide redundancy and prevent error propagation, parameters may also be repeated until they change every k frames. Alternatively, the processor 119 may be configured to transmit regularly every k frames without any asynchronous transmissions.

Thus, in the example given above where the ITD parameter can have a value in the range of −48 to +48 and the predetermined bit pattern is 00, the ITD parameter value is sent asynchronously whenever the ITD parameter is updated by a calling routine by first sending a predetermined bit pattern of 00 in a frame and then sending the parameter value over 5 subsequent frames using 2 bits per frame. If no updates are made or the value remains constant, the ITD parameter value is sent every 5 frames.

Asynchronous transmission of data is known, for example, in the High-Level Data Link Control (HDLC) protocol and asynchronous character mode transmission between a computer and a modem. In the latter, each information character or byte is individually synchronised or framed by the use of Start and Stop Elements and can be transmitted and received at irregular and independent time intervals. The HDLC protocol is designed for serial transmission and relies on a start and end marker of 01111110. Confusion within the bit stream is avoided by inserting a zero after any five consecutive Is, except in the event of the start or stop marker. A problem with HDLC is that it is not constant bandwidth since an all '1' sequence in general requires more bandwidth than the all '0' sequence. Also, these known techniques use start and stop markers and are for transmitting characters or sequential bit streams of varying length.

It will be appreciated that the n bits transmitted over k frames may be used to encode one parameter or a plurality of parameters, such as a sequence of parameters, with the plurality of parameters having a predetermined length. In other words with the possible values of the plurality of parameters being in a predetermined range.

The output multiplexer 117 multiplexes the encoded data representing the encoded speech signals from the mono encoder 115 and the encoded data representing the encoded ITD parameter from the apparatus 119 into a single output bit stream. The inclusion of the ITD parameter in the bit stream assists the decoder in recreating a stereo signal from a mono signal decoded from the encoding data.

Figure 5:
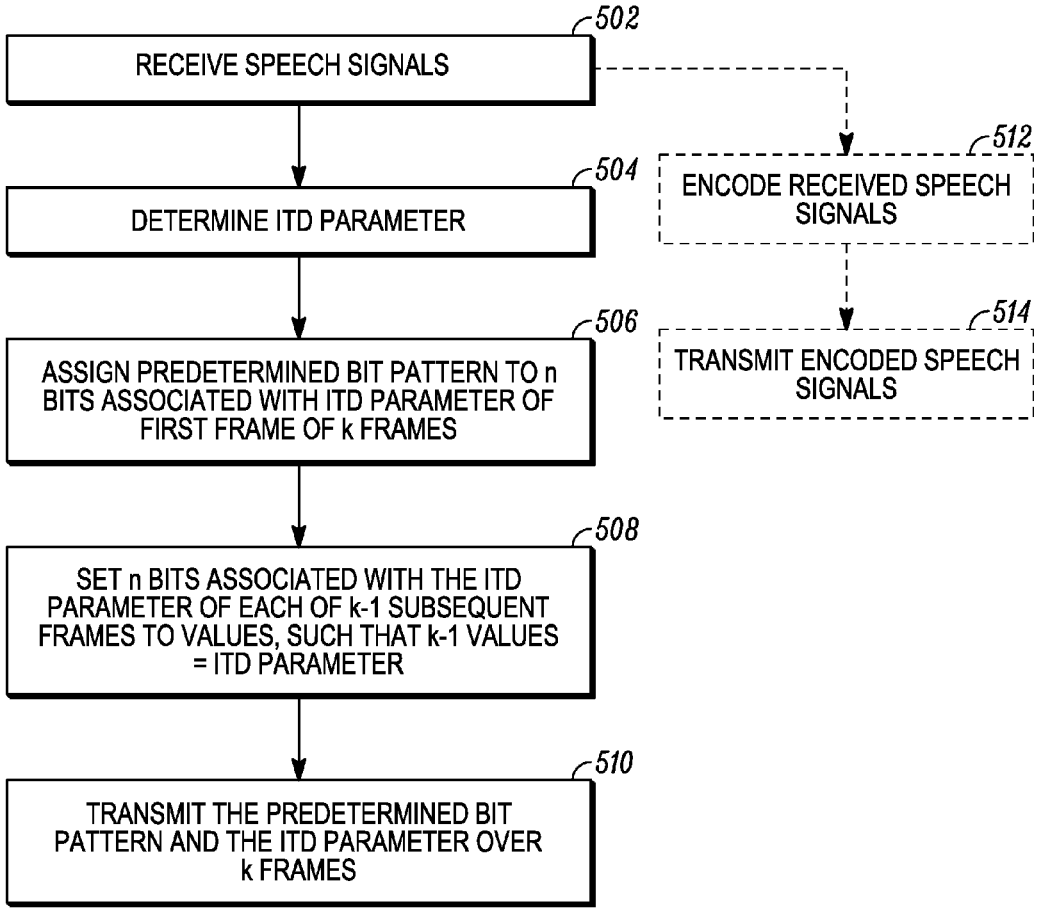
FIG. 5 is a flow diagram of a method for encoding at least one parameter associated with a signal source for transmission over a plurality of frames in accordance with an embodiment of the disclosure.

A method of encoding at least one parameter associated with a signal source for transmission over k frames to a decoder in accordance with an embodiment of the disclosure will now be described with further reference to FIG. 5.

At step 502, the speech signals are received on multiple channels from respective microphones 101, 103 and an ITD parameter for the received speech signals is determined, step 504. The ITD parameter is encoded by apparatus 119 by assigning a predetermined bit pattern to n bits associated with the ITD parameter of a first frame of k frames, step 506 and by setting the n bits associated with the ITD parameter of each of k−1 subsequent frames to values, such that the values of the n bits of the k−1 subsequent frames represent the at least one parameter, step 508. The predetermined bit pattern indicates a start of the ITD parameter. The predetermined bit pattern and the ITD parameter associated with the signal source are then transmitted over the k frames to the decoding apparatus 122, step 510. In an embodiment, the received speech signals are encoded at step 512 and then the encoded speech signals are transmitted to the decoding apparatus 122 at step 514. In the embodiment shown in FIG. 2, the encoded speech signals, the predetermined bit pattern and the encoded ITD parameter are combined and transmitted over the frames in a single bit stream.

The decoding apparatus 122 of the receiving communication device 14 receives the predetermined bit pattern and the values of the ITD parameter over k−1 frames, transmitted by the transmitting communication device 12 and is arranged to decode the received information to provide a decoded ITD parameter. The decoding apparatus decodes each of the received frames to determine the value of each bit in a frame. When the decoding apparatus detects the predetermined bit pattern (e.g. 00) in the n bits associated with the ITD parameter, the decoding apparatus determines that the frame including the predetermined bit pattern represents the start of the ITD parameter and is the first frame of k subsequent frames from which the ITD parameter can be determined. The decoding apparatus then takes the values of the decoded n bits associated with the ITD parameter of the subsequent k−1 frames and combines the values to obtain the ITD parameter.

In the case that the k−1 values are sent least significant digit first, in base $2^n-1$, the ITD parameter, I, will be formed from the received values, $r_i$, according to the following formula:

$$I = \sum_{i=1}^{k-1} (2^n - 1)^{i-1} r_i \tag{1}$$

In the case that the k−1 values are sent most significant digit first, in base $2^n-1$, the ITD parameter, I, will be formed from the received values, $r_i$, according to the following formula:

$$I = \sum_{i=1}^{k-1} (2^n - 1)^{i-1} r_{k-i} \tag{2}$$

The decoding apparatus is also arranged to decode the received encoded speech signals and to process the decoded speech signals according to the decoded ITD parameter so as to provide to a user (or users) of the receiving communication device 14 a re-creation of the speech signals provided to the microphones 101, 103.

In the example described above, the processor 119 encodes the ITD parameter. It will be appreciated that the processor 119 in accordance with the present disclosure may be used to encode other parameters that are associated with a signal source or signal(s) from a source and which parameters change at a rate that is less than the frame rate. Such other parameters may include one or more of the following: signal source identification parameter, such as a talker label based on a local talker identification or simply seat position in a room, camera label, active microphone label, and security watermark identifying the terminal, head related transfer function (HRTF) description parameter, room reverberation description parameter, local signal-to-noise ratio (SNR) measure parameter, and time stamp parameter (for archive or verification purposes). It will also be appreciated that the processor 119 may be arranged to encode more than one parameter for transmission over the k frames. In this latter case, the plurality of parameters are encoded within $(2^n-1)$ (k−1) values provided by the n bits of the k−1 frames.

The processor 119 has been shown and described as a separate processor to the frame processor 105, the ITD processor 107, the mono encoder 115 and the output multiplexer 117. It will be appreciated that the number of processors and the allocation of processing functions to the processors is a matter of design choice for a skilled person when implementing a parameter encoding arrangement in accordance with this disclosure.

In summary, the present disclosure provides for at least one parameter to be encoded by n bits per frame and transmitted over k−1 frames with a predetermined bit pattern being sent in the n bits in the first frame of the k frames to indicate the start of the parameter. Thus, the encoding technique in accordance with the disclosure allows for the concatenation of parameter information from multiple (k−1) frames so that update rates slower than the frame rate (e.g., 50 Hz) can be achieved. By having a predetermined bit pattern to indicate the start of the parameter, the encoding arrangement in accordance with the disclosure allows for the transmission of the parameter to be asynchronous. By enabling asynchronous transmission of the parameters, the transmission can start at any frame which makes the transmission robust and self-synchronising with minimal transmission delay.

Furthermore by encoding and transmitting a parameter in n bits over k frames, the encoding arrangement in accordance with the disclosure allows for low frame-by-frame bit rate in order to encode the parameter and so there are more 'free' bits of the frame to be used for sending other data. In addition, the same n bits are used every frame to transmit the encoded parameter, and thus, the arrangement in accordance with the disclosure enables the parameter to be encoded with low complexity.

A further advantage of the disclosure is that memory propagation issues and jitter problems associated with the practical realisation of the filtering necessary for over-sampled transmission are minimised by retransmitting parameters regularly. In addition, predictable delays in transmission allow low delay parameter changes whilst maintaining encoder and decoder synchronization which is required in analysis-by-synthesis encoder structures.

In the foregoing description, the invention has been described with reference to specific examples of embodiments of the invention. It will, however, be evident that various modifications and changes may be made therein without departing from the broader scope of the invention as set forth in the appended claims.

The invention claimed is:

1. An audio signal encoding apparatus for encoding at least one audio signal parameter associated with a signal source for transmission over k frames of an encoded bitstream, the apparatus comprising:

a processor configured in operation to:

assign a predetermined bit pattern to n bits associated with the at least one audio signal parameter of a first frame of k frames, the predetermined bit pattern indicating a start of the at least one audio signal parameter; and set the n bits associated with the at least one audio signal parameter of each of k−1 subsequent frames to values, such that the values of the n bits of the k−1 subsequent frames represent the at least one audio signal parameter;

wherein the values of the n bits in each of the k−1 subsequent frames are selected to be different to values of the n bits of the predetermined bit pattern; and wherein the at least one audio signal parameter is encoded within $(2^n-1)^{(k-1)}$ values provided by the n bits of the k−1 frames.

2. The apparatus according to claim 1, wherein k and n are integers greater than one.

3. The apparatus according to claim 1, wherein the n bits of the frame following the first frame represents a least significant or most significant digit of the at least one audio signal parameter.

4. The apparatus according to claim 1, wherein the at least one audio signal parameter has a value in a predetermined range.

5. The apparatus according to claim 1, wherein the at least one audio signal parameter includes a plurality of parameters.

6. The apparatus according to claim 5, wherein the plurality of parameters are encoded within $(2^n-1)^{(k-1)}$ values provided by the n bits of the k−1 frames.

7. The apparatus according to claim 1, wherein the at least one audio signal parameter includes at least one of the following parameters: stereo delay parameter, signal source identification parameter, head related transfer function (HRTF) description parameter, room reverberation description parameter, local signal-to-noise ratio measure parameter, and time stamp parameter.

* * * * *